United States Patent [19]

Roccaforte

[11] 4,362,239

[45] Dec. 7, 1982

[54] DISPLAY CARD WITH CONCAVE PANEL

[75] Inventor: Harry I. Roccaforte, Western Springs, Ill.

[73] Assignee: Champion International Corporation, Stamford, Conn.

[21] Appl. No.: 196,662

[22] Filed: Oct. 14, 1980

[51] Int. Cl.[3] ..... B65D 5/50

[52] U.S. Cl. ..... 206/45.14; 206/45.26; 206/485; 229/16 D

[58] Field of Search ..... 206/485, 45.26, 45.14, 206/45.21, 277, 491, 327; 229/16 D

[56] References Cited

U.S. PATENT DOCUMENTS

| | | | |
|---|---|---|---|
| 3,815,735 | 6/1974 | Cucuo | 206/485 |
| 3,887,067 | 6/1975 | Collura et al. | 206/45.26 |
| 3,918,583 | 11/1975 | Adams | 206/485 |
| 4,141,448 | 2/1979 | Mascia et al. | 206/485 |
| 4,191,289 | 3/1980 | Austin | 206/485 |

FOREIGN PATENT DOCUMENTS

| | | | |
|---|---|---|---|
| 1163260 | 4/1958 | France | 206/485 |
| 1171598 | 10/1958 | France | 206/485 |

*Primary Examiner*—Joseph Man-Fu Moy
*Attorney, Agent, or Firm*—Evelyn M. Sommer

[57] ABSTRACT

A display support in which a back wall is provided with a pair of horizontal walls; and a front concave wall which is a smooth concave curve without any folds therein extending continuously in an arc from the outer edge of one horizontal wall to the outer edge of the other horizontal wall. A fold line is provided in the back wall transverse to the back wall and parallel to the horizontal walls. By providing this fold line in the back wall at a specific location which is substantially equal to the sum of the lengths of the two horizontal walls and the back wall minus the linear length of the front concave wall divided by two, a minimum of indenting of the back wall is obtained in order to obtain the smooth contour of the front concave wall.

12 Claims, 8 Drawing Figures

FIG. 4.
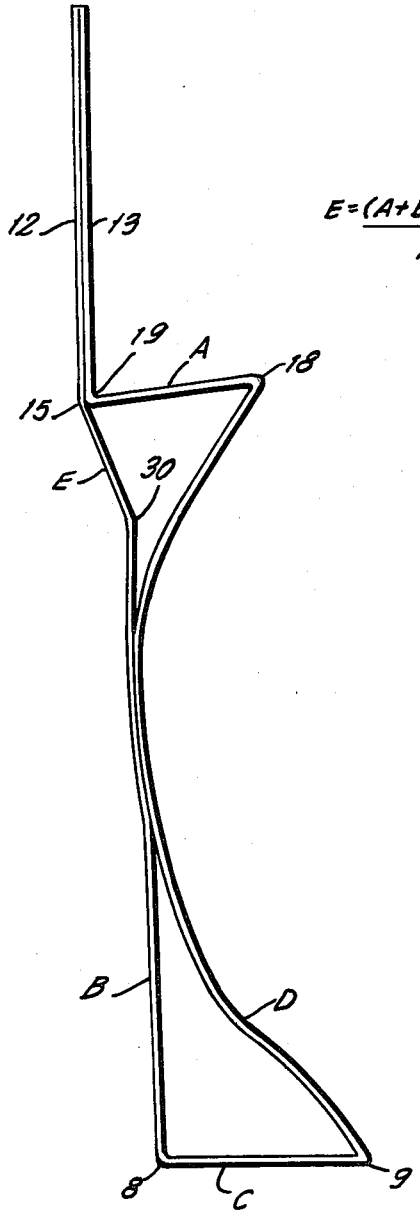
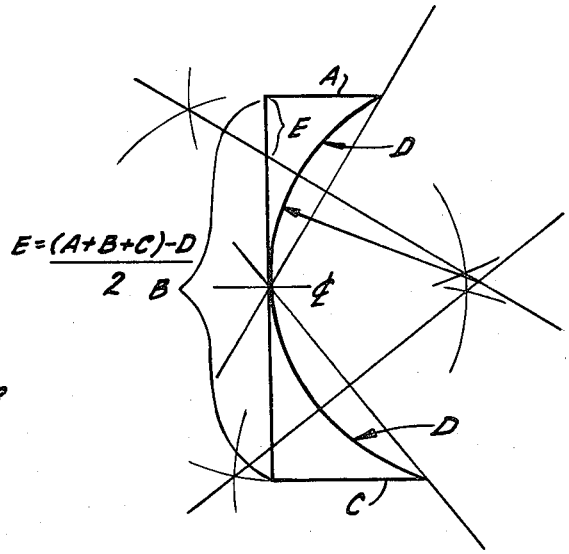
FIG. 5.
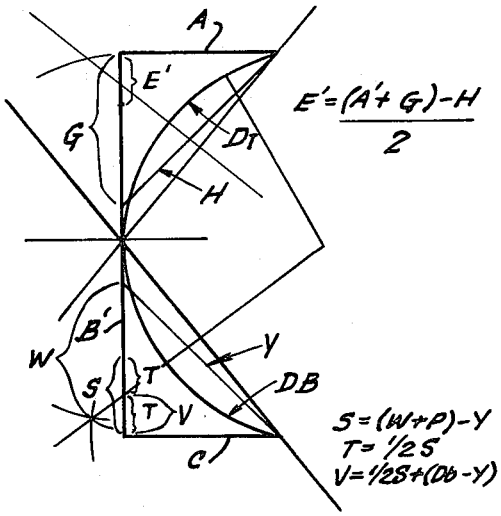
FIG. 6.

DISPLAY CARD WITH CONCAVE PANEL

The present invention relates to display cards for supporting and displaying merchandise and more particularly to a display card having a back and a concave front panel.

Such display cards are known and are used for displaying and supporting cylindrical containers at the point of sale. The back of the display card is frequently extended upwardly to form a perforated hanging tab with a space for appropriate informational or trademark material and the front of the display card is, at the top and bottom, extended outwardly by horizontal panels to define a concave panel between the top and bottom horizontal panel; the concave panel is provided with openings therein adjacent the top and bottom horizontal panels to receive the cylindrical container which is being displayed.

The parts of the display card are connected, usually by various forms of adhesive. Since the display card is preferably made from a single blank which is folded up appropriately to provide the concave front panel, the concave front panel was, in prior structures, necessarily provided with an added score so that proper alignment for gluing and proper dimensional relationship of all the parts might be obtained.

The utilization of a score in the concave panel tends to defeat the desired uniformity and smoothness of the display card. Even though part of the score line might be covered by the merchandise which is being displayed or the score line may be placed in such a position that it is less visible or it may appear as defining a bottom ledge or platform, nevertheless, the score line is present and interferes with the smooth concave curve of the front panel.

The present invention is directed to the formation of a merchandise display and support panel having a back and a concave front with openings near the top and bottom of the concave front to receive the merchandise to be displayed, wherein the concave front panel is a regular curve without any score lines therein which will interfere with the smooth flow and appearance of the curve. This smooth curve is achieved by placing a score in the back panel at a particular dimensional relationship (hereinafter defined) to the remainder of the blank including the top and bottom horizontal panels, the concave panel and the point of securement of the concave panel to the back panel.

In order to achieve the desired smooth flow of the concave curve of the front panel, this invention is therefore directed to a specific location of the score line on the back panel. Noting that in addition to the hanging panel the display card comprises a top substantially horizontal panel, a bottom substantially horizontal panel, a back panel connected at its opposite ends to the horizontal panels and the concave panel connected at its opposite ends to the outer ends of the horizontal panels—it has been found, in accordance with the present invention that the placement of a score line transversely of the back panel by a distance below the top panel which is equal to the sum of the lengths of the two top panels plus the back panel, minus the length of the concave panel divided by two, permits the back panel to assume a slightly bent appearance when viewed from the side, but in turn permits the concave panel at the front which is viewed by the customer to have a smooth and regular curve.

In other words, the distance of the placement of the transverse score on the back panel is equal to half the difference between the sum of the three straight panels (the two horizontal panels and the back panel) and the curved panel. This type of structure does not require the adherence of the front concave panel to the back panel and actually the complete support structure for the object which is carried at the concave panel is obtained by insertion of the object which then ensures that the top panel and the bottom panel will be substantially parallel to each other and substantially normal to the back panel.

In order to create a sturdier structure, the concave panel may be adhesively secured to the rear panel. Where the line of securement has some substantial width a pair of such score lines is used transversely to the back panel adjacent the top horizontal panel and adjacent the bottom horizontal panel. The spacing of each score line in the back panel from the related horizontal panel is determined by adding together the length of the horizontal panel and the distance on the back panel from the horizontal panel to the top of the adhesive line, subtracting the secant from the outer edge of the top horizontal panel to the top of the adhesive line and dividing the result by two. Similarly the placement of the bottom score line is obtained by the same kind of calculation adding the sum of the length of the bottom panel to the distance on the back panel between the bottom panel and the bottom of the adhesive line, subtracting the secant on the concave panel or the distance between the outer end of the bottom panel and the bottom of the score line and dividing the result by two.

The utilization of this type of calculation in order to specifically place the score line produces the unexpected result that the concave front panel becomes a smooth panel which from the point of view of the customer who views the support and display container with the merchandise carried therein, produces a smooth, continuous even, and highly acceptable curved arrangement which enhances the appearance of the merchandise and the appearance of the entire supported display.

Thus, the primary object of the present invention as above set forth is the specific placement of a score line in the back panel of a compound display panel having a concave curvature at the front with recesses therein for supporting an object wherein the score line in the back panel is specifically placed as above-described in order to permit the result of a smooth concave surface at the front where the merchandise displayed is viewed.

A further object of the present invention is to provide a reinforced container with a concave front panel where the concave front panel is smooth and where the concave front panel is secured to the back panel over a substantial segment thereof in order to reinforce the same, while at the same time utilizing the principle above set forth with respect to the placement of the score line in the back panel to maintain the smooth curvature of the concave front panel.

A further object of the present invention is the provision of further reinforcement means for the display and support member having a concave front surface.

The foregoing and many other objects of the present invention will become apparent in the following description and drawings in which:

FIG. 4 is a side view of the display and support container of FIG. 3 without the merchandise placed therein.

FIG. 5 is a diagrammatic view showing the method of determining the optimum placement of a score line in the back panel of the structure of FIGS. 1 to 4 in order to maintain the smooth concave surface of the front panel of the structure of FIGS. 3 and 4.

FIG. 6 is a view corresponding in part to that of FIG. 5 showing an alternate method of determining the placement of a plurality of score lines in the back panel of a structure having a concave front surface such as that of FIGS. 7 and 8 where the concave panel is secured to the back panel thus making the display structure inherently stronger.

Figure 1:
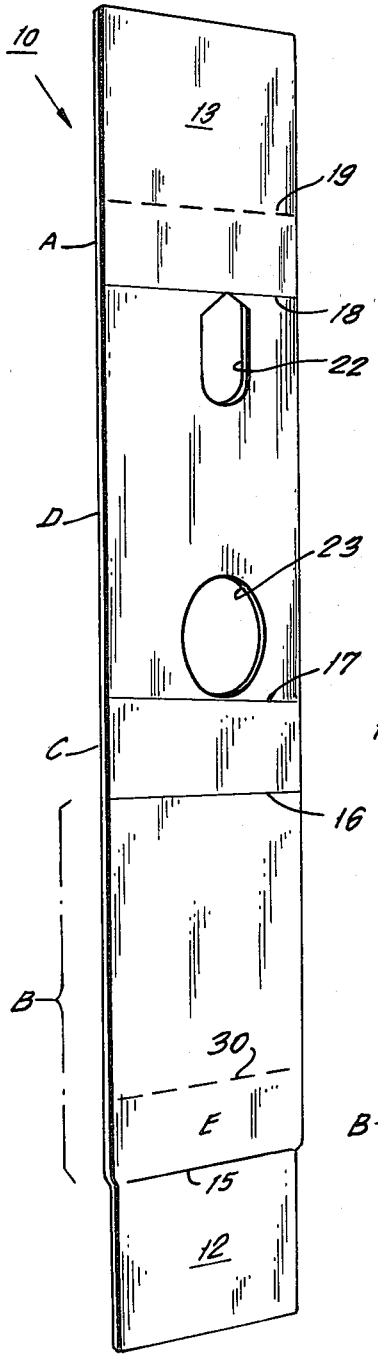
FIG. 1 is a plan view in perspective of a blank for making the display and support container of the present invention.
Figure 2:
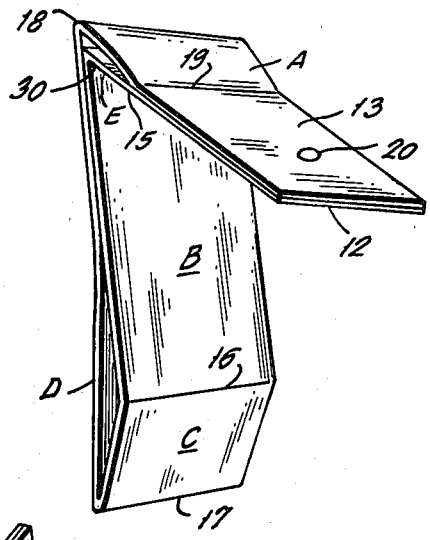
FIG. 2 is a view in perspective of the blank secured together but in partly collapsed condition showing the completed display and support container made from the blank of FIG. 1 but without the display merchandise therein.

Referring first to FIGS. 1 through 5. The blank 10 of FIG. 1 comprises the front concave panel D, the back panel B, the top horizontal panel A, the bottom horizontal panel C and a pair of panels 12 and 13 which are secured together in any suitable manner preferably by an adhesive to form the upwardly directed suspending panel for the entire display structure. As seen by a comparison of FIG. 1, on the one hand, with FIGS. 2, 3, and 4 on the other hand, the back panel B is connected at one end by the fold line 15 to the display and support or hanging panel section 12. At the other end of the back panel B, a connection is made by the fold line 16 to the bottom horizontal panel C. The outer end of bottom horizontal panel C is connected by fold line 17 to the bottom of the front concave panel D. The opposite end of the front concave panel D is connected by the fold line 18 to the upper horizontal panel A. The upper horizontal panel A is connected by the fold line 19 to the support panel 13 which is adhesively secured in surface-to-surface relation with panel 12 after the unit is folded up, so that a completed support structure is formed.

Figure 3:
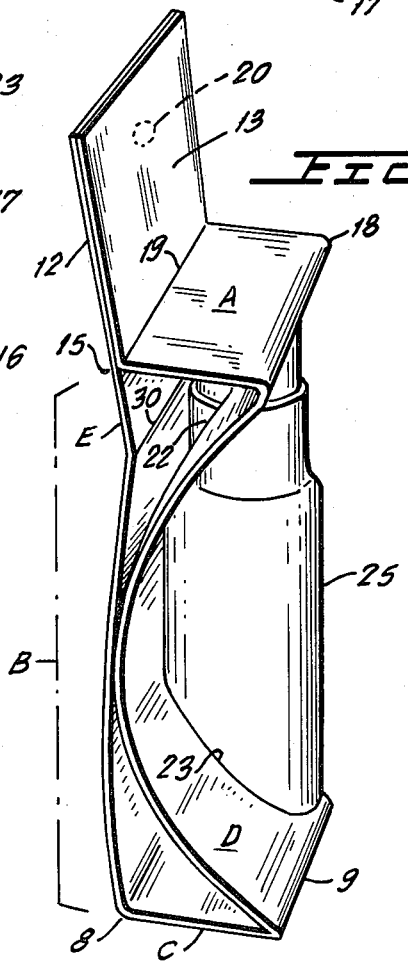
FIG. 3 is a view in perspective of the display and support container of FIG. 2 made from the blank of FIG. 1 with the merchandise to be displayed supported therein and assisting in maintaining the conformation of the display and support container.

The composite panel 12–13 may as shown in FIG. 3 have an opening 20 therein by which the said panel may be hung if that is desired thereby supporting the entire display structure with its contents. The display structure with its contents may also be stood on the panel C and offered for sale in that position. The concave panel D is provided with upper and lower openings 22 and 23 shaped to support a structure 25 which is offered for sale in the display structure of FIGS. 1 to 4. The upper and lower openings 22, 23 may be shaped to receive the item 25 which is displayed as shown in FIG. 3.

In constructing the unit, the panel C is bent in a counterclockwise direction with respect to FIGS. 3 and 4 from the flat position to the horizontal position. The concave wall D is bent around the fold line 13 also in a counterclockwise direction with respect to FIGS. 3 and 4 so that the panel D might abut panel B. Panel A is bent in a counterclockwise direction with respect to FIGS. 3 and 4 around the fold line 18 to the position shown in FIG. 4 and panel 13 is bent in a clockwise direction around the fold line 19 with respect to FIGS. 3 and 4 so that it comes into surface-to-surface relation with the panel 12 which extends from the back wall. In this case it will be seen that the fold line 15 is placed so that the panel 12 may be readily placed in surface-to-surface relation with panel 13, although no actual rotation around the fold line 15 is expected. The fold line 15 is provided so that the conformation of the structure shown particularly in FIGS. 3 and 4 may be achieved.

The securement together of the upper suspending or display panels 12 and 13 determines the geometric conformation of the unit particularly as shown in FIGS. 3 and 4. As previously described, in order to ensure that the concave surface D is a smooth curve, when the panels 12, 13 are secured together it is necessary to provide a bend line 30 in a section of the back wall B defining the panel section E in the back wall B.

The provision of this bend line 30 permits the back wall B to bend so that the panel E will extend at an angle with respect to the panel B and thereby provide an automatic adjustment of the effective length of the entire panel B from the upper horizontal panel A to the lower horizontal panel C that will maintain the panels A and B substantially parallel to each other, while at the same time maintaining the smooth curvature of the concave panel D with the back of the concave panel D bearing against the front surface of the back wall B. The location of the fold line 30 to define the panel B becomes critical and it has been found in accordance with this invention that the length of the panel E from the top horizontal wall A to the fold line 30 should be preferably in accordance with the following formula:

$$E = \frac{(A + B + C) - D}{2}$$

In other words, the height of E from the fold line 30 to the upper horizontal panel A is equal to the difference between the length of the front concave panel D and the sum of the two horizontal panels A and C and the entire back panel B divided by 2.

With the fold line 30 located so that the length of panel E is in accordance with the formula as determined by taking measurements along the lines as indicated particularly in FIG. 5, a smooth concave curvature is provided for the panel D without any wrinkles or fold lines in the panel D; since panel D faces the customer and displays the merchandise, this provides a highly effective sales tool particularly in such passive environments as supermarket shelves where the item to be sold must be displayed and sold on its striking appearance and its merits without the assistance of a sales person to influence the purchaser.

In the structure in FIGS. 1 to 4 the display device is arranged for what may be regarded as substantially light containers usually generally cylindrical objects where the stresses on the display device are not expected to be large. Where heavier units are utilized in connection with the display device of the present invention, then it may be preferred to utilize the structure shown in FIGS. 7 and 8 dimensioned with respect to each other as described in connection with FIG. 6.

Figure 7:
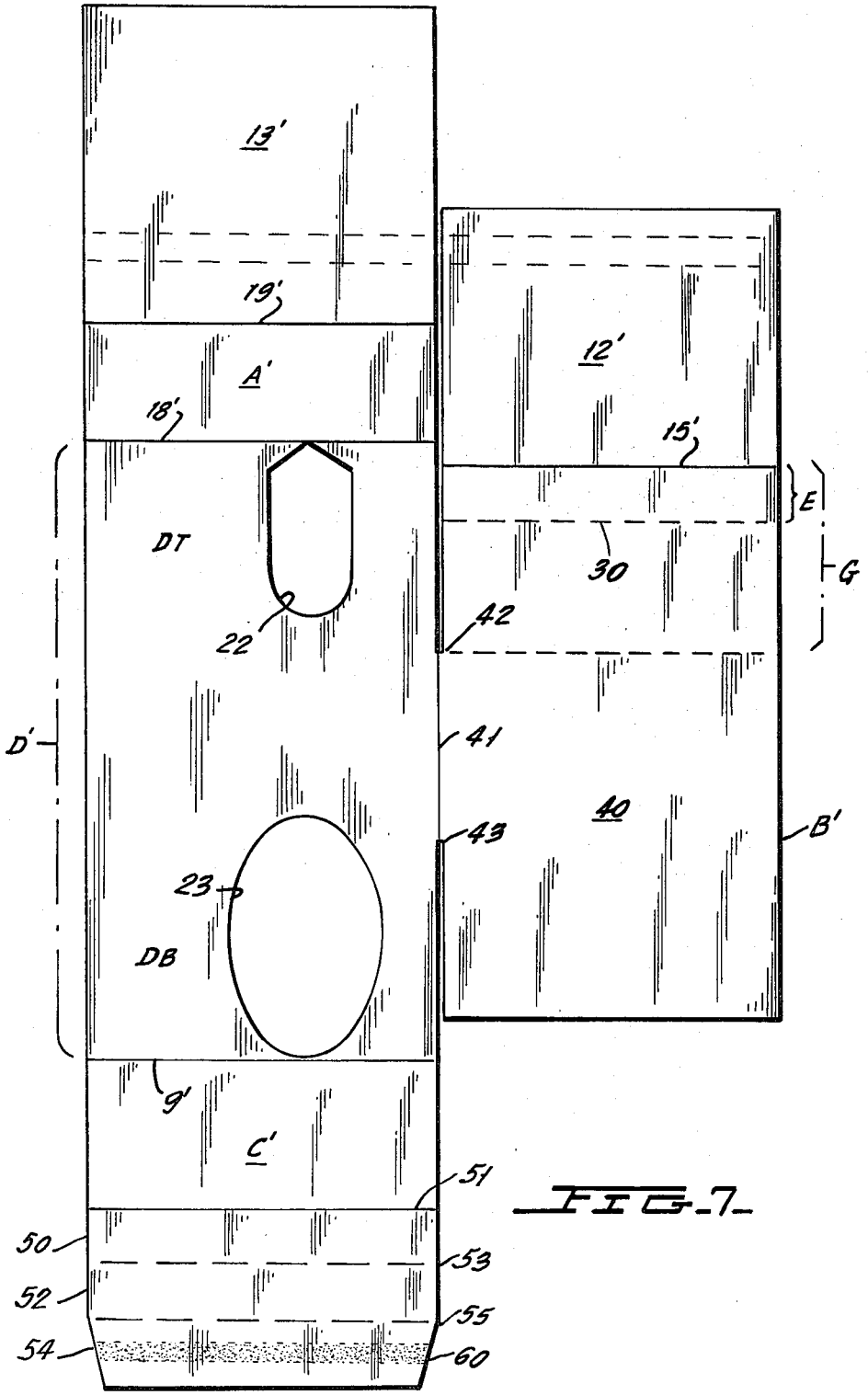
FIG. 7 is a plan view of a blank for the formation of the display and support panel of FIG. 8 utilizing the principles diagrammatically illustrated with respect to FIG. 6.
Figure 8:
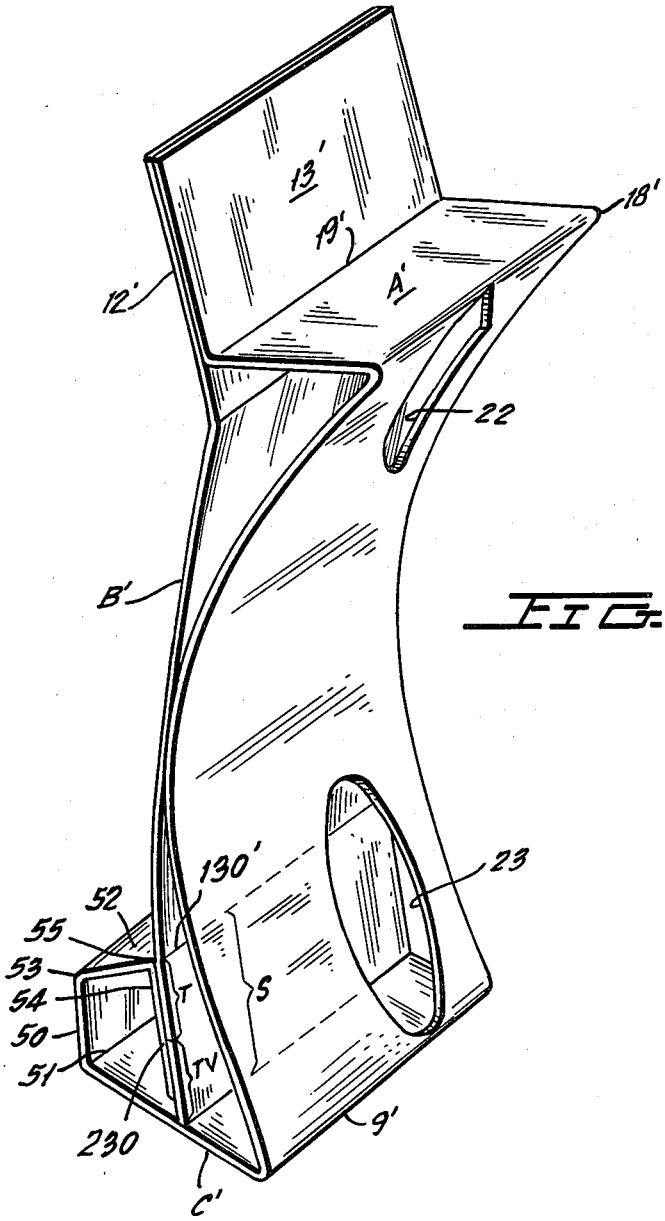
FIG. 8 is a view in perspective of a display and support panel made from the blank of FIG. 7 utilizing the principles diagrammatically illustrated in FIG. 6.

In FIGS. 7 and 8 the structure is reinforced and arranged so that the center section of the concave wall D' is secured to the back wall section B' at the area 40. For this purpose the back wall section B' is shown in the blank to be hingedly connected along the fold line 41 to a corresponding portion of the concave wall D' transversely across the center thereof. In the construction of the unit from the blank of FIG. 7 into the structure of FIG. 8, the front wall D' is folded on the fold line 41 so that its center overlies the corresponding center section 40 of the back panel B'. This center section 40 is defined by the length of the fold line 41 between the notches 42, 43. The intersecurement of section 40 of the back wall panel B' with the center of the concave panel D' may be by adhesive or any other suitable means. Thereafter the panels are bent up in a manner similar to that described in connection with FIGS. 1 to 4 with variations, of course, owing to the difference in structure. That is the upper horizontal panel A' is bent in a counterclockwise direction with respect to FIG. 7 around the bend line 18' and the section 13' of the securement or mounting panel is bent in a clockwise direction with respect to FIG. 8 around the fold line 19', thereby creating the horizontal wall A' and part of the support member.

Continuing with respect to the top of the structure, the panel B' having been placed in surface-to-surface relation with the panel D' and the section 40 having been secured to the transverse center section of the panel B', the panel 12' extends upwardly from the panel B' and is in surface-to-surface relation with the narrow bent up panel 13' and may be adhesively secured thereto. The reason for the difference in level, in the blank, of the fold line 18' and the lower boundary 15' of the panel 12' is that in order to create the concavity shown for the front panel D' in FIG. 8 the fold line 19' moves down to match the boundary 15' of the panel 12' when the unit is folded from the blank of FIG. 7 to the structure of FIG. 8 to create the structure shown in FIG. 8.

At the lower end of the unit the panel C' is folded in a clockwise direction with respect to FIG. 8 around the fold line 9' to the horizontal position. Thereafter the auxiliary panel 50 connected by fold line 51 is folded up from the horizontal panel C'; the panel 52 connected by fold line 53 to the upper end of panel 50 is folded in a clockwise direction with respect to FIG. 8 and the panel 54 connected by the fold line 55 to the panel 52 is folded again in a clockwise direction with respect to FIG. 8 so that the panel 54 is in surface-to-surface relation with the lower end of the back panel B' to which it may be adhesively secured by the line of adhesive 60.

Here again the principles described in connection with FIG. 5 are used with some modification to achieve the same kind of smooth curvature at the concave panel D as was previously described. In this case the dimensional relationship is demonstrated in FIG. 6 wherein the distance from the bottom of panels 12'–13' to the additional and important score line 30', that is the distance E', is dimensionally related to the remainder of the structure as follows: The length of the upper horizontal panel A' and the length of the back panel from its juncture with the upper horizontal panel A' and the top of section 40, that is the notch 42, are added together. From this is substrated the secant dimension G from the outer end of the horizontal panel A' and the top of the section 40 as determined by the position of notch 42. This result is then divided by 2.

As shown in the drawing and as now described this dimensional relationship may be illustrated as follows:

$$E' = \frac{(A' + G) - H}{2}$$

Another way of stating the formula and producing the desired curve is to take the section of the concave front panel between the upper section of the adhesive area 40 as determined by the location of the bottom of notch 42 and the end of horizontal panel A' which is connected to the front panel which section is marked Dt on FIG. 6. Subtract from that the dimension H which is a secant across the arc Dt and use this difference to determine the dimension E and the location of the additional score line 30' of FIGS. 6 and 7.

Where additional refinement of the curve is desired, then, at the lower portion, the same type of dimensioning of the location of the score line 130' may be utilized to determine the total dimension S. The distance S will then equal the length of the horizontal panel C' plus the distance W on the back wall between the horizontal panel and the lower portion, at notch 43, of the back wall glue section, minus the secant Y between the outer portion of the lower horizontal panel C' and the notch area 43. This secant Y extends across the curved section Db of the front curved panel D'.

An additional score line 230 may be provided between the score line 130' and the bottom panel C' where the distance T between the two score lines equals half the distance S between the score line 130 and the bottom panel C'. When it is desired to smooth the curve out completely, then the lower section between the lower score line 230 and the bottom panel C' may be varied by adding to this lower portion Tv the difference between the secant Y between the outer section of the horizontal panel C' and the notch 43 and the length of the arcuate section Db between the same boundaries so that Tv will equal one half $S+(Db-Y)$.

By this means therefore, a simplified structure is provided whereby the utilization of a score line at the appropriate location in the back panel of the display unit permits the concave front panel to be smooth.

The structure shown in FIGS. 7 and 8 and as described diagrammatically with respect to FIG. 6 are primarily directed to the kind of merchandise which will warrant the additional expense of the stronger and slightly more complex structure shown in FIGS. 7 and 8, and which also has such size or weight as to warrant the added support which the structure of FIGS. 7 and 8 provide. Essentially as pointed out above, the essence of the invention lies in the fact that a score line at the back wall is used in order to accommodate the back wall and the concave front wall to each other so that the concave front wall will remain smooth and so that no score is presented in the concave front wall.

Essentially, again, this entails the arrangement of a score line in the back wall so that the relationship between the distance of the score line in the back wall from the top of the horizontal wall is determined by adding together the length of the back wall, the length of the two horizontal walls then subtracting the total length of the curved front concave wall and dividing the result by two.

Where the concave front wall is secured at a center section to the back wall then essentially the upper and lower halves of the structure from the point of securement to the top and from the point of securement to the bottom are individually treated in essentially the same way.

In the foregoing the present invention has been described in connection with illustrative embodiments thereof. Since many variations and modifications of the present invention will now be apparent to those skilled in the art, it is preferred that the scope of this disclosure be determined not by the specific disclosures herein contained but only by the appended claims.

What is claimed is:

1. A display support for an article of merchandise, said support comprising a back wall; a top horizontal wall; a bottom horizontal wall; said horizontal walls extending from said back wall; a smooth concave curved front wall without any folds therein extending continuously in an arc from the outer edge of the top horizontal wall to the outer edge of the bottom horizontal wall; at least one opening in the concave front wall for supporting merchandise to be displayed; said back wall being provided with a transverse score line parallel and adjacent to one of the horizontal walls and spaced from said one horizontal wall thereby permitting the back wall to bend at the transverse score line to maintain the smooth curvature of the front concave wall.

2. The display support of claim 1, wherein said transverse score line is spaced from the adjacent horizontal wall by a distance which is equal to the sum of the length of the back wall and the top and bottom horizontal walls from which is subtracted the linear length of the front concave wall and with the result divided by two.

3. The display support of claim 1, wherein the spacing of the transverse score line from the adjacent horizontal wall is expressed by the following formula:

$$E = \frac{(A + B + C) - C}{2}$$

where A and C are the top and bottom horizontal walls respectively; B is the back wall; and D is the linear length of the front concave wall.

4. The display support of claim 1, wherein the back wall is extended above the top horizontal wall and said top horizontal wall is provided with an additional flap which is folded upwardly in surface-to-surface relation with the extension of the back wall to provide a display section and support for the display device.

5. The display support of claim 4, said display section also comprising a hanging section having a perforation therein.

6. The display support of claim 1, wherein said front concave wall is secured to said back wall substantially at the center thereof and in which at least one score line is provided in the back wall between each horizontal wall and the securement section in order to permit the curvature of said front wall to remain smooth by permitting said back wall to bend at said score line.

7. The display of container 6, wherein the said score lines are provided adjacent the top and bottom horizontal walls; the spacing of each score line from each top and bottom wall being determined by adding the length of said horizontal wall to the distance on the back wall from the horizontal wall to that portion of the securement section of the front wall to the back wall which is adjacent to said horizontal wall and subtracting from this sum the secant distance from the outer edge of the horizontal wall to said portion of the securement area adjacent thereto and dividing this diference by two.

8. The display support of claim 7, the back wall being provided with a transverse score line similarly spaced with respect to the bottom wall and the top wall.

9. The display support of claim 6, wherein the relationship of said additional score line on the back wall for each section of the back wall is expressed by the formula:

$$E' = \frac{(A' + G) - H}{2}$$

where A′ is one of the horizontal walls; G is the distance along the back wall from said horizontal wall to the area of securement of the front wall to the back wall most adjacent to the said horizontal wall; H is the secant distance along an arc of the front wall from the outer edge of the said horizontal wall to said portion of the securement of the front wall to the back wall which is most adjacent to the said horizontal wall.

10. The display support of claim 9, wherein an additional score line may be provided adjacent one of the said horizontal walls between the first-mentioned score line located adjacent thereto and the said horizontal wall; said additional score line being located half-way between the first-mentioned score line and said horizontal wall.

11. The display support of claim 9, said front wall comprising a panel hingedly connected to the back wall along one side of the back wall normal to said horizontal walls; said hinge connection extending along a central section spaced from each of the horizontal walls; said front panel being foldable around said hinged connection into surface-to-surface relation to said back wall and being adhesively securable thereto along an area having a pair of substantially parallel boundaries, one spaced from the upper horizontal wall and the other spaced from the lower horizontal wall.

12. The display support of claim 9, said horizontal wall having a further rearward extension beyond the back wall and additional panels extending from said rearward extension foldable into a substantially quadrangular member having one panel adhesively secured to the rear of said back wall.

* * * * *